US008198829B2

(12) United States Patent
Balasubramanian

(10) Patent No.: US 8,198,829 B2
(45) Date of Patent: Jun. 12, 2012

(54) INTENSITY BALANCE FOR MULTIPLE LAMPS

(75) Inventor: Jaiganesh Balasubramanian, Tualatin, OR (US)

(73) Assignee: Leviton Manufacturing Co., Inc., Melville, NY (US)

( * ) Notice: Subject to any disclaimer, the term of this patent is extended or adjusted under 35 U.S.C. 154(b) by 303 days.

(21) Appl. No.: 12/634,588

(22) Filed: Dec. 9, 2009

(65) Prior Publication Data

US 2011/0133656 A1 Jun. 9, 2011

(51) Int. Cl.
*H05B 37/02* (2006.01)

(52) U.S. Cl. ..... 315/294; 315/95; 315/185 R; 315/224; 315/DIG. 1

(58) Field of Classification Search ..... 315/95, 315/105, 185 R, 224, 294, 307, DIG. 1, DIG. 4
See application file for complete search history.

(56) References Cited

U.S. PATENT DOCUMENTS 3,482,142 A * 12/1969 Cluett et al. ..... 315/105
3,984,726 A * 10/1976 Ramler ..... 315/107
4,734,650 A 3/1988 Alley et al.
5,408,162 A 4/1995 Williams
5,568,018 A 10/1996 Musiz
5,973,455 A * 10/1999 Mirskiy et al. ..... 315/105
6,281,641 B1 * 8/2001 Chen et al. ..... 315/307
6,300,728 B1 * 10/2001 Blackburn et al. ..... 315/307
6,310,439 B1 10/2001 Jacoby, Jr. et al.
6,459,216 B1 10/2002 Tsai
6,472,876 B1 * 10/2002 Notohamiprodjo et al. .. 324/414
6,922,023 B2 7/2005 Hsu et al.
7,045,967 B2 * 5/2006 Chen et al. ..... 315/224
7,151,345 B2 12/2006 Sanchez
7,151,346 B2 12/2006 Sanchez
7,190,123 B2 3/2007 Lee
7,253,564 B2 8/2007 Hsu et al.
7,319,297 B2 1/2008 Kuo
7,330,708 B2 * 2/2008 Umewaka et al. ..... 455/193.1
7,446,485 B2 11/2008 Huang
7,482,758 B2 1/2009 Hua et al.
7,525,258 B2 4/2009 Kim et al.
7,545,101 B2 6/2009 Hick et al.
7,608,807 B2 10/2009 Hick et al.
2002/0105283 A1 * 8/2002 Murakami et al. ..... 315/224
2007/0164686 A1 7/2007 Ribarich et al.
2007/0285020 A1 12/2007 Yao et al.
2008/0111496 A1 5/2008 Lee et al.
2008/0129222 A1 6/2008 Chen et al.
2008/0211426 A1 9/2008 Kuo et al.
2009/0096387 A1 4/2009 Fang et al.

* cited by examiner

*Primary Examiner* — Douglas W Owens
*Assistant Examiner* — Thai Pham
(74) *Attorney, Agent, or Firm* — Marger Johnson & McCollom Pc

(57) ABSTRACT

A compensation system includes first and second sensors to determine the intensities of first and second fluorescent lamps, a compensator to control the intensity of the first lamp, and a controller to adjust the intensity of the first lamp to about the same intensity as the second lamp. The lamps may be coupled in series, and the compensator may be arranged to divert current around or away from one of the lamps.

35 Claims, 7 Drawing Sheets

INTENSITY BALANCE FOR MULTIPLE LAMPS

BACKGROUND

FIG. 1 illustrates a prior art fluorescent light fixture. The fixture has a sheet metal chassis 10 and two fluorescent lamps 12 and 14. The lamps are connected in series and powered by a ballast 16. The main AC power out of the ballast is applied across the red and blue leads, while the yellow lead provides a center connection. In some ballasts, there may be only one of each color lead, while in others, there may be two leads of each color to provide power for heating filaments at each end of the lamp.

Because the lamps are connected in series, all of the current flowing through one lamp nominally flows through the other lamp, and therefore, the two lamps should appear to have the same intensity. Various factors, however, may cause different amounts of current to flow through each lamp. For example, fluorescent lamps tend to be sensitive to metallic objects located close to the lamp. If the sheet metal chassis 10, which may include a reflector, a ballast cover, etc., is slightly wavy or has a dent as shown at 18, or is otherwise closer to one lamp than the other, it may cause a current imbalance. As another example, the relative lamp currents may be affected by differences in wiring impedance caused by the routing of wire leads within the fixture. This is illustrated in FIG. 1 where an excess portion of the blue lead is arranged loosely in the fixture, whereas the excess portion of the red lead is tightly coiled in a manner that may give the red lead a higher inductance than the blue lead. An additional source of current imbalance is manufacturing tolerances of the lamps which may cause different impedances, current requirements, etc.

When operating at moderate to high power levels, current imbalances caused by these factors tend to be less noticeable because the leakage or unbalanced currents are relatively small compared to normal lamp operating currents. For example, if two series-connected lamps are operating at a few hundred milliamps, a few milliamps of imbalance is unlikely to cause a perceptible difference in the relative intensity of the two lamps. As the ballast power is reduced, and the lamps are dimmed to a lower brightness level, the current imbalance may become more pronounced, and one lamp may appear significantly brighter than the other, especially at the lowest dimming levels.

DETAILED DESCRIPTION

Figure 2:
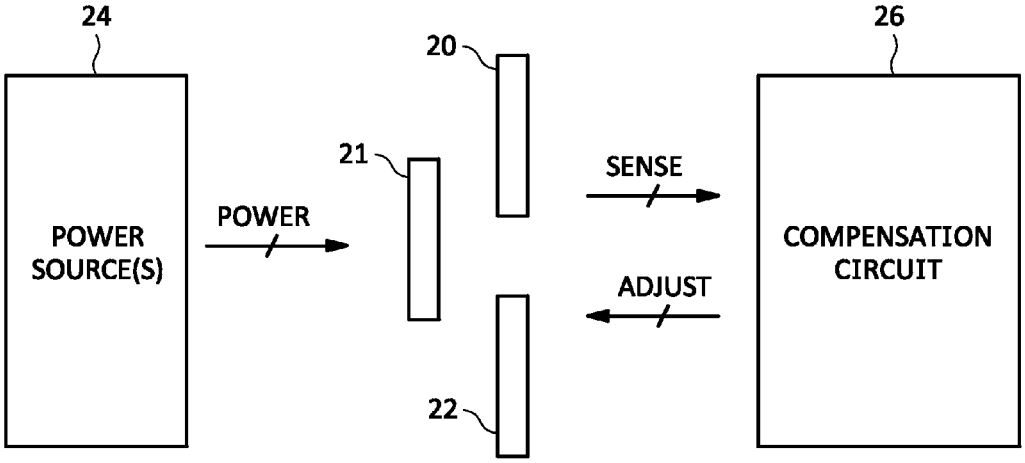
FIG. 2 illustrates an embodiment of a lamp compensation system according to some inventive principles of this patent disclosure.

FIG. 2 illustrates an embodiment of a lamp compensation system according to some inventive principles of this patent disclosure. Two or more lamps 20-22 are operated by one or more power sources 24. A compensation circuit 26 senses the relative intensity of the lamps and compensates one or more of the lamps so the lamps operate at about the same intensity. The system of FIG. 2 may be used with any arrangement in which at least one of the lamps may be compensated relative one or more of the other lamps. One example is an arrangement in which two series connected lamps are powered by a ballast having a single AC power source. Another example is an arrangement in which one lamp is powered by a first AC power source and a second lamp is powered by second AC power source which may be in the same or a separate ballast.

The one or more power sources may include electronic inverters with resonant circuits, magnetic ballasts, or any other suitable source or sources of AC power to operate the lamps. The compensation circuit may use any suitable sensing technique such as sensing lamp current, lamp voltage, lamp power, etc. Current sensing may be implemented with one or more current transformers, current sense resistors, Hall effect sensors or other suitable sensors. Voltage sensing may be implemented with transformers, resistive dividers, etc. Lamp compensation may be implemented with any suitable technique such as diverting current around or away from a lamp. Compensation may be applied to one, some, or all of the lamps.

Figure 3:
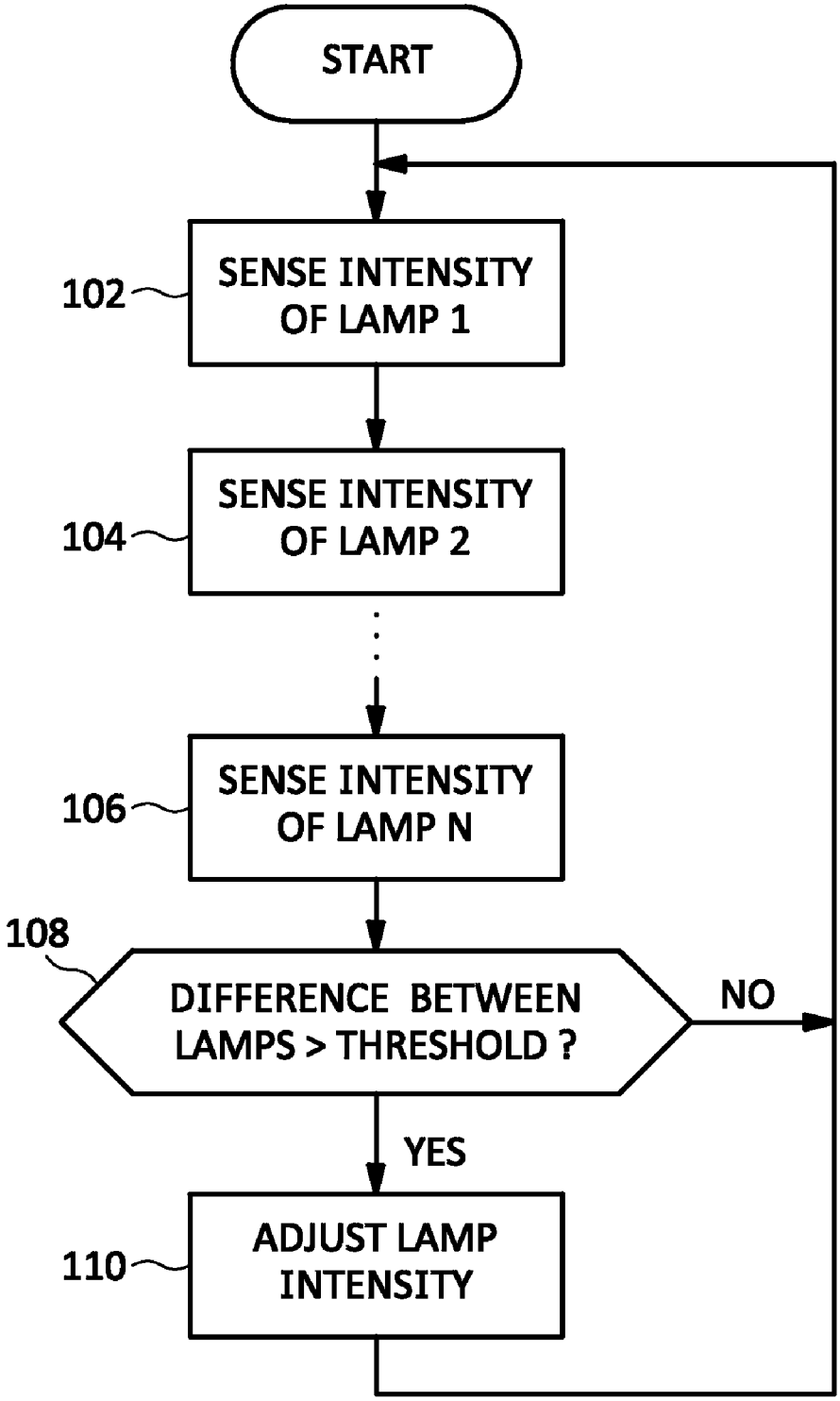
FIG. 3 illustrates an embodiment of a method for compensating a lamp according to some inventive principles of this patent disclosure.

FIG. 3 illustrates an embodiment of a method for compensating a lamp using the system of FIG. 2 according to some inventive principles of this patent disclosure. The method begins by sensing the intensities of all N lamps at 102-106. At 108, the intensities of all of the lamps are compared. If the difference between all of the intensities is within a threshold value, the process returns to the beginning. If any of the lamps differ by an amount that is greater than a threshold value, the intensities of one or more of the lamps are adjusted at 110 until their intensities are about equal. The process is then repeated.

Figure 4:
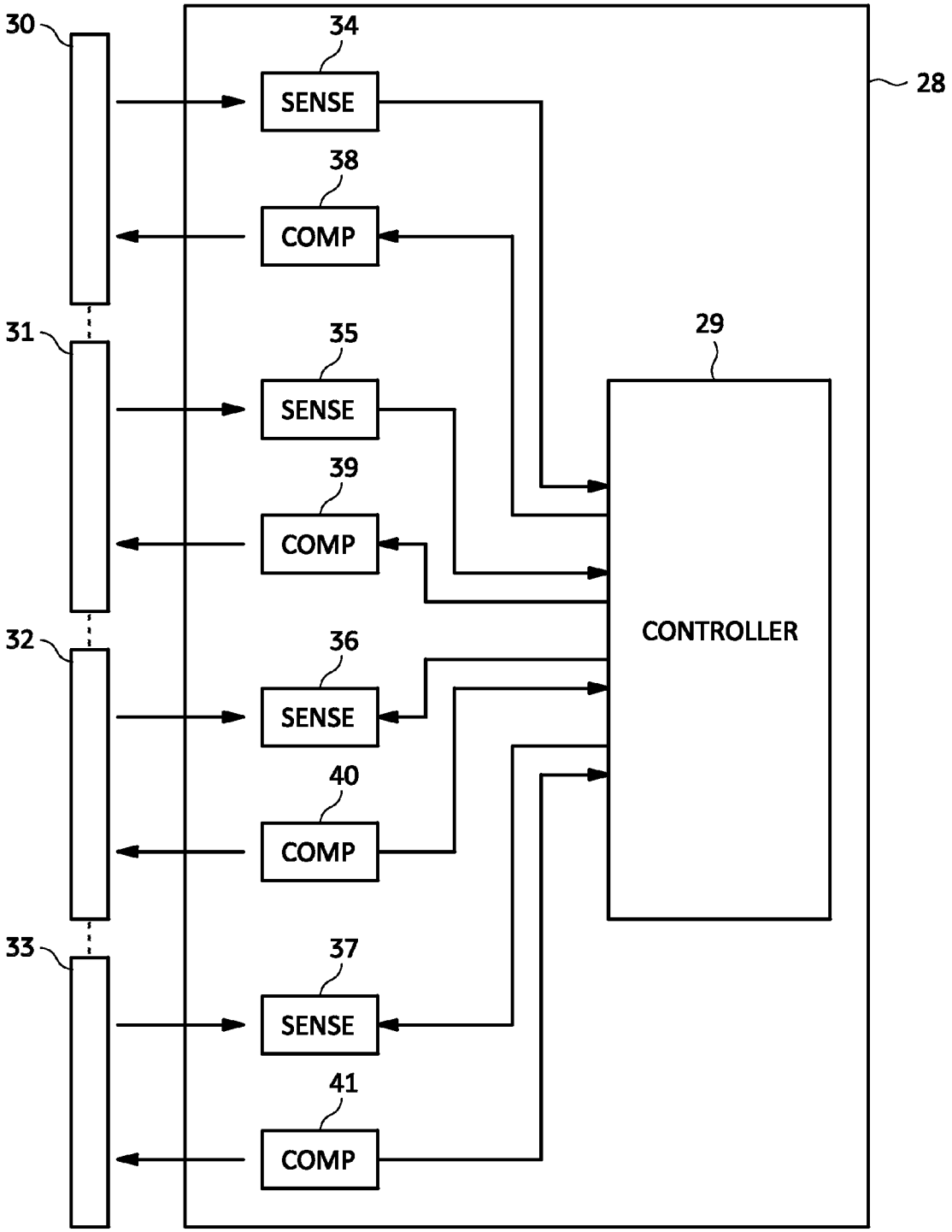
FIG. 4 illustrates another embodiment of a lamp compensation system according to some inventive principles of this patent disclosure.

FIG. 4 illustrates another embodiment of a lamp compensation system according to some inventive principles of this patent disclosure. The embodiment of FIG. 4 is illustrated in the context of four lamps, but the inventive principles are not limited to a specific number of lamps. Moreover, the lamps in FIG. 4 are shown with dotted line connections to indicate a series arrangement, but other configurations are possible where one or more of the lamps may be compensated separately. The embodiment of FIG. 4 may be used with lamps connected in series to a single power source, lamps powered by separate power sources, or any other arrangement in which one or more of the lamps may be compensated relative to another lamp.

In the embodiment of FIG. 4, a compensation circuit 28 includes sensors 34-37 to determine the intensities of lamps 30-33, respectively. Compensators 38-41 are arranged to control the intensities of lamps 30-33, respectively. A controller 40 is coupled to the sensors and compensators to adjust the intensity of the lamps to about the same level. The number and arrangement of components illustrated in FIG. 4 may be varied any suitable manner. Not every lamp must have a corresponding sensor and/or compensator, and some lamps may have more than one of each or either. For example, a three lamp embodiment may have three lamps connected in series where each lamp has one sensor, but only two of the lamps have corresponding compensators.

Figure 5:
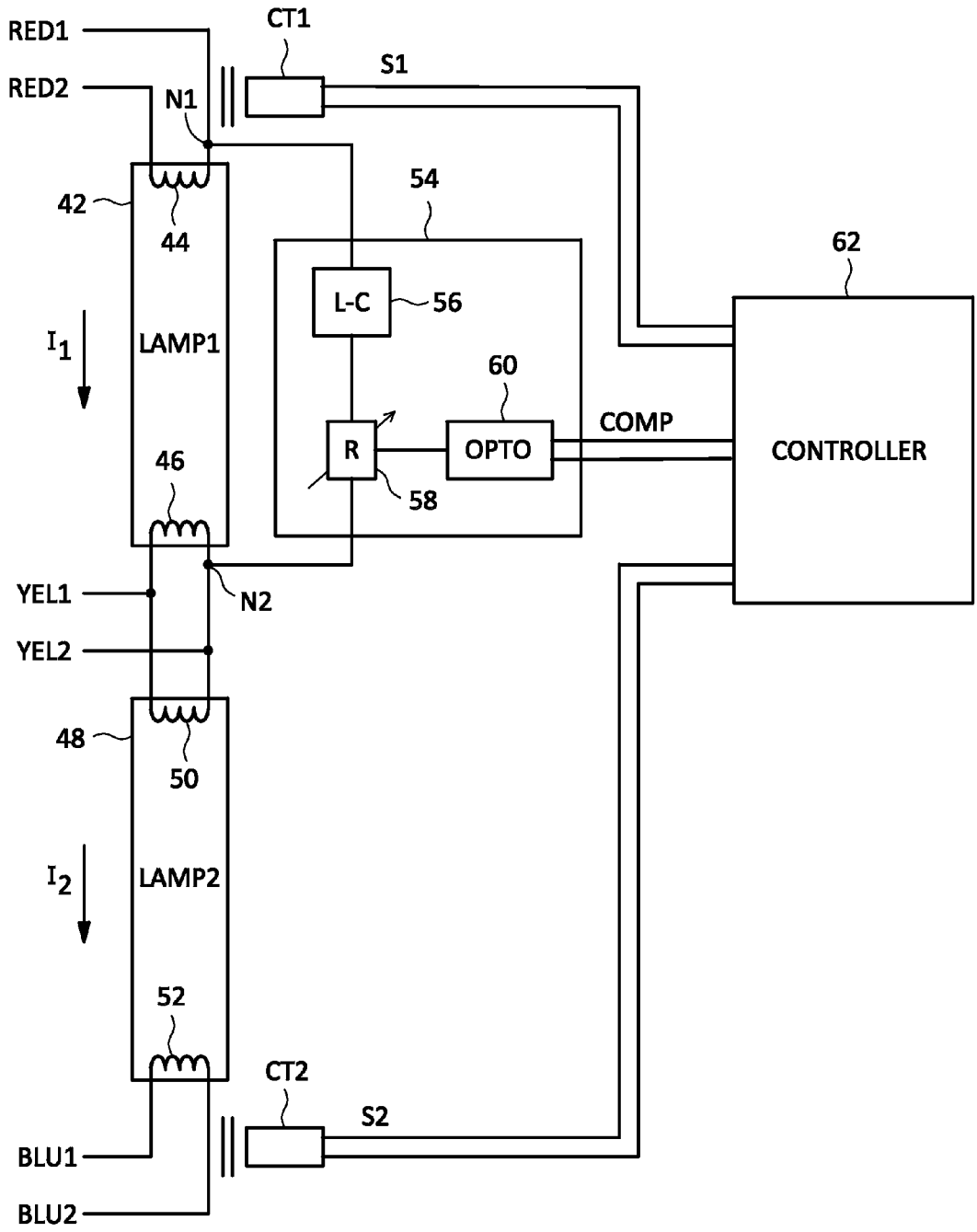
FIG. 5 illustrates another embodiment of a lamp compensation system according to some inventive principles of this patent disclosure.
Figure 7:
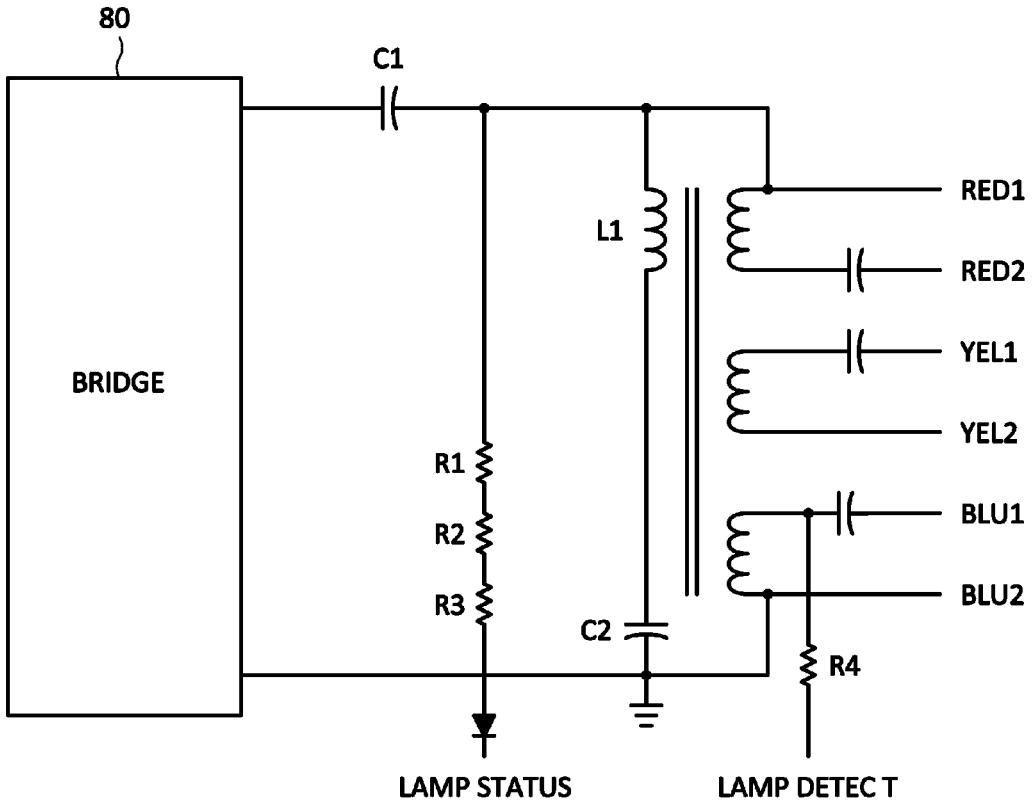
FIG. 7 (PRIOR ART)
FIG. 7 illustrates a prior art resonant lamp circuit that can be readily integrated with a compensation system according to some of the inventive principles of this patent disclosure.

FIG. 5 illustrates another embodiment of a lamp compensation system according to some inventive principles of this patent disclosure. The embodiment of FIG. 5 is illustrated in the context of two series-connected fluorescent lamps that are driven by an electronic ballast having a high-frequency, high-voltage inverter bridge, a resonant L-C tank circuit, and a transformer with secondary windings to heat the lamp filaments as illustrated in FIG. 7. The inventive principles, however, are not limited to these specific details.

Referring to FIG. 5, a first lamp 42 includes a first filament 44 powered by a first secondary winding through leads RED1 and RED2, and a second filament 46 powered by another secondary winding through leads YEL1 and YEL2. A second lamp 48 includes a first filament 50 connected in parallel with the second filament of the first lamp, and a second filament 52 powered by a third secondary winding through leads BLU1 and BLU2.

The lamp current through the first lamp is sensed by a first current transformer CT1 which may be, for example, a toroidal transformer. Both of the red filament leads may be passed through CT1 so it operates as a differential transformer and measures the true lamp current $I_1$ while ignoring any cathode current through the filament 44. A second current transformer CT2 is arranged in a similar manner on the blue leads to measure the lamp current $I_2$ of the second lamp.

A compensator 54 is connected in parallel with the first lamp 42 between nodes N1 and N2. The compensator in this example includes an inductor-capacitor (L-C) network 56 arranged in series with a variable resistor 58. An optoisolator 60 couples the variable resistor 58 to a controller 62. In this example, the variable resistor includes a digital potentiometer in which one end of the resistance string is used as one of the two resistor terminals and the wiper is used as the other. The digital potentiometer includes a multiplexer to selectively couple the wiper to the resistor string in response to a digital signal COMP received from the controller 62 through optoisolator 60.

In this example, the controller is implemented with a microcontroller having any suitable interface circuitry to convert the sense signals S1 and S2 from the current transformers into a digital format. The sense signal, for example, may be rectified and applied to resistors to convert them to voltage form, then read with an analog-to-digital converter (A/D converter or ADC).

In this example, only one compensator 54 is included. This may be suitable for arrangements where any imbalance between the lamps is likely to be unidirectional, i.e., any imbalance is likely to cause one specific lamp to be brighter than the other. In other embodiments, another compensator for the second lamp may be included. A second compensator may be more suitable where changing conditions may cause either lamp to be brighter than the other, or where it is not known at the time of manufacture or installation which lamp is likely to be brighter as a result of imbalances.

Figure 6:
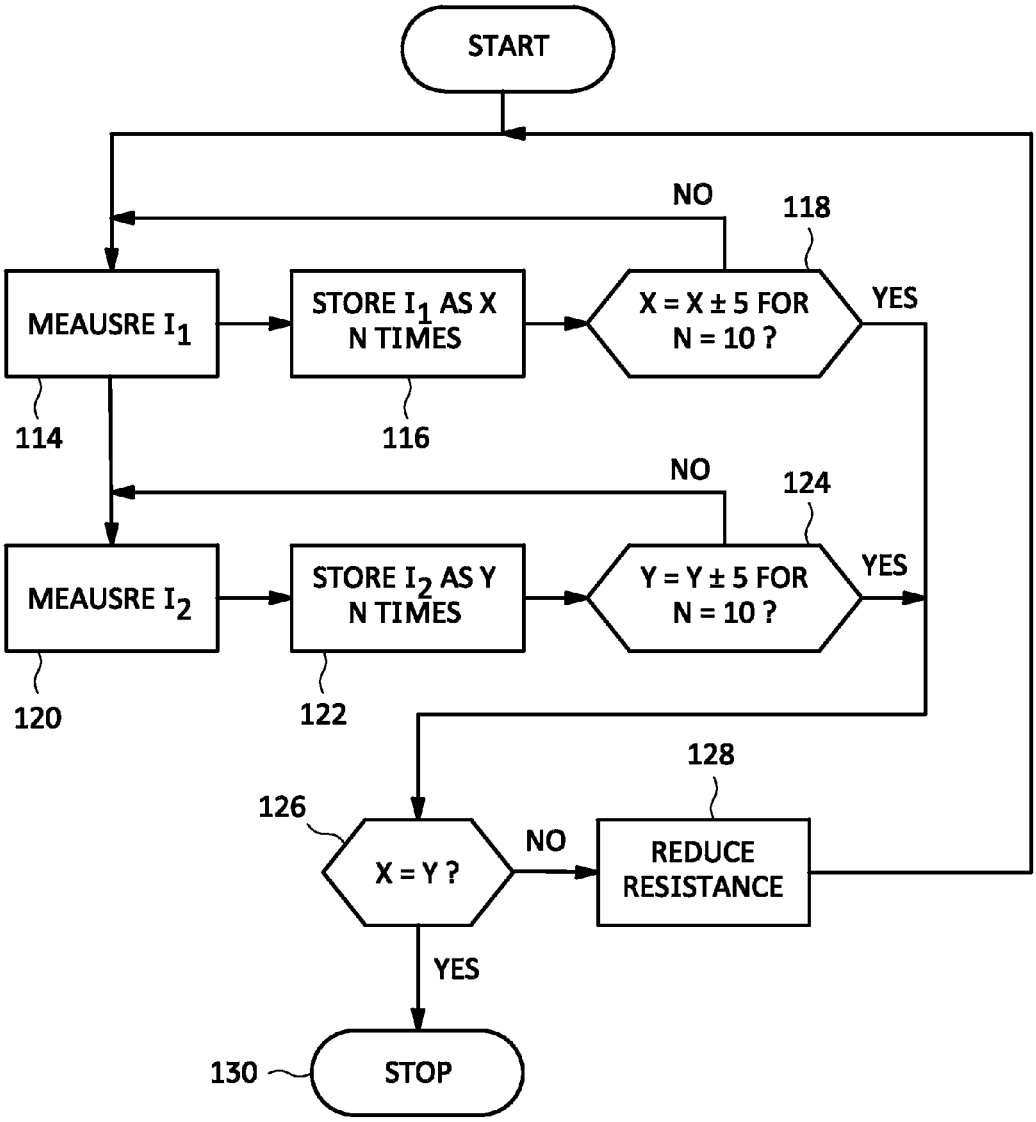
FIG. 6 illustrates an embodiment of a method for compensating a lamp according to some inventive principles of this patent disclosure.

FIG. 6 illustrates an example embodiment of a method for compensating a lamp according to some inventive principles of this patent disclosure. The embodiment of FIG. 6 may be used, for example, with the controller 62 of FIG. 5. Referring to FIG. 6, the method begins at 114 by measuring the first lamp current $I_1$. The value of $I_1$ is stored as X a predetermined number of times, in this example, ten times at 116. At 118, the method branches back to 114 until the successive measured values are within a predetermined range for a minimum number of measurements. As one example, the system may continue to measure the lamp current until each successive measurement varies by less than two percent for ten consecutive measurements. At 120, value of $I_2$ is stored as Y a predetermined number of times at 122, and at 124, the method branches back to 120 until the successive measured values are again within a predetermined range for a minimum number of measurements.

At 126, the method compares the stored values of X and Y. If they are equal, or within a predetermined range, the method stops at 130. If X and Y are too far apart, the resistance of the variable resistor 58 is reduced. This causes the combination of the L-C network 56 and variable resistor 58 to conduct more current, thereby diverting more lamp current from the first lamp 42 and reducing its intensity. The method then returns to the beginning.

The method may stop indefinitely at 130, or it may be reset at any suitable time, such as at power up, when a significant change in the dimming level is detected, etc. Moreover, the method may be modified to back off on the amount of compensation applied to the first lamp if the relative intensities of the lamps become unbalanced in the opposite direction.

Numerous refinements may be added to the embodiment of FIG. 6 in accordance with the inventive principles of this patent disclosure. For example, when determining whether the currents $I_1$ and $I_2$ are equal, a threshold value may be used. In one example embodiment, the threshold may be about five percent of $I_1$ or $I_2$. Moreover, the system may include another loop in which the difference between $I_1$ and $I_2$ must exceed the threshold for a certain number of measurements, e.g., twenty measurements, before any corrective action is taken.

The incremental amount by which the resistance is decreased during each iteration may be set to any suitable value. The amount may be fixed regardless of the difference between $I_1$ and $I_2$ i.e., the error, or the increment may vary linearly or nonlinearly with the error, etc.

The time scale of the overall loop, any sub-loops, etc., may be set to any suitable value. The time between successive current measurements during sub-loops, if any, while measuring the values of $I_1$ and $I_2$, for example, may be set to a period roughly equal to the switching frequency of an inverter in the ballast which may be in the 40-70 KHz range.

A power supply to operate the controller 62 may be derived from any suitable source. For example, power may be obtained directly from the lamp circuit through the current transformers, or through a resistive divider or transformer connected across the lamp followed by a rectifier, a capacitor and a clamp or regulator. Alternatively, the power supply may be derived from a source that generates the power supply for a control circuit in the ballast.

The controller may repeat any of the loops continuously and indefinitely while the lamps are operating. Alternatively, the controller may be arranged to disable any compensation loop during select time periods, for example, when the lamps are operating moderate to high dimming levels. In some embodiments, the controller may drive the variable resistor to its lowest value when the lamps are operating a relatively high power, so the L-C network is essentially connected directly across the first lamp 42. This may result in some leakage current bypassing the lamp, but the amount of current may be low enough that it does not affect the perceptible brightness of the lamp.

The embodiment of FIG. 5 may be modified extensively in accordance with the inventive principles of this patent disclosure. The compensator 54 is illustrated as a passive L-C network with a variable resistor. The network may be as simple as a single capacitor, but any suitable compensation circuit may be use. For example, any combination of one or more variable inductors, variable capacitors, etc., may be used with any arrangement of resistors, diodes, snubbers, etc. The compensator may also include active components such as transistors, thyristors, relays, etc.

In the embodiment of FIG. 5, the variable component is adjusted digitally, but in other embodiments, one or more components may be adjusted in response to an analog control signal, a combination of analog and digital signals, etc. As one example, a variable component having an analog input may be controlled by converting a pulse width modulated (PWM) signal from the controller to an analog form through a suitable filter.

The current transformers CT1 and CT2 illustrated in the embodiment of FIG. 5 may be arranged to measure the lamp currents at any suitable points in the circuit. They may be moved to the ends of the lamps near the center connection to the yellow leads. They may be coupled to both or either of the conductors connected to the filaments. Moreover, the current transformers may be replaced with any type of sensors. Depending on the application, the peak current may be measured without transformers using a resistive divider followed by a diode, with or without filtering. The controller 62 may also be implemented in any suitable manner. For example, rather than a microcontroller, an analog comparator circuit may use used to drive one or more compensators in response to the sensed lamp currents. Thus, a simple, low cost, and highly reliable embodiment may use resistive dividers and an analog comparator to eliminate the current transformers, microcontroller, and any accompanying power supply.

FIG. 7 illustrates a prior art resonant lamp circuit that can be readily integrated with a compensation system according to the inventive principles of this patent disclosure to provide enhanced performance. The circuit of FIG. 6 includes an inverter bridge 80 that drives a resonant tank circuit including capacitor C1 and inductor L1, which also serves as the primary winding of a transformer. The secondary windings of the transformer provide the filament heating power to leads RED1 and RED2, YEL1 and YEL2, and BLU1 and BLU2. The actual lamp current for igniting and maintaining the lamps is applied across leads RED1 and BLU2.

The inventive principles described above may provide numerous benefits, some of which are as follows. Because a compensation system according to the inventive principles may be able to operate independently of the normal lamp power source, it may be easy and/or inexpensive to integrate into an existing power source. For example, it may be possible to integrate the compensation system of FIG. 5 into the inverter system of FIG. 7 with little or no alteration to the inverter system which may have been tested and characterized thoroughly. Moreover, the compensation system of FIG. 5 may perform its functions without interfering with various features such as the lamp detect circuit and/or the lamp status circuit shown in FIG. 6 which may be used by a controller to detect the presence of a lamp and/or whether a lamp has failed to strike.

Figure 8:
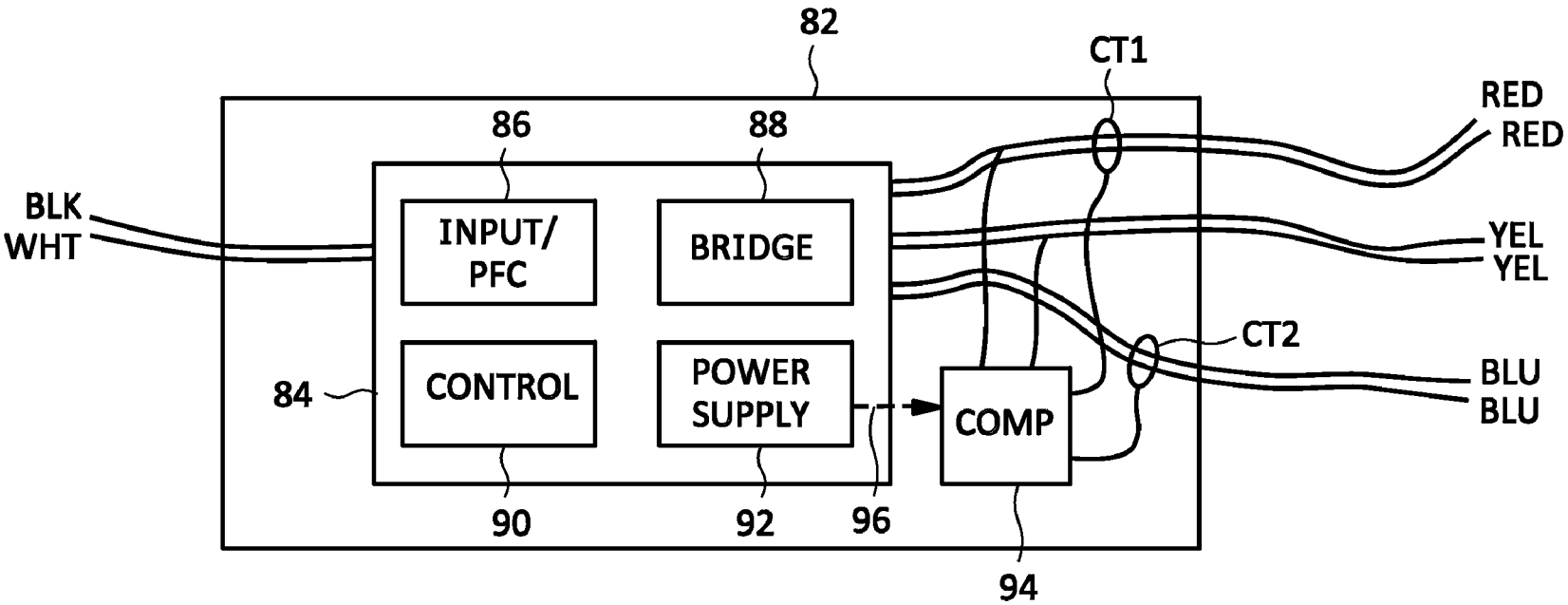
FIG. 8 illustrates an embodiment of a ballast having lamp compensation according to some inventive principles of this patent disclosure.

Referring to FIG. 8, the embodiment of FIG. 4 may be included in an existing ballast design with little or no modification. The ballast may have a housing 82 that contains a power source 84 having an input/PFC section 86, a bridge 88, a controller 90 and power supply 92. The compensation system may take up very little additional space with the controller and compensator fabricated in a module 94. Lamp leads RED1, RED2 and BLU1, BLU2 may be threaded through current transformers CT1 and CT2 before they exit the housing. Connections for the compensator and/or other sensor or power supply purposes may be made to the lamp leads at any suitable location. A power supply connection 96 may be provided from an existing control power supply or from an extra winding.

Figure 1:
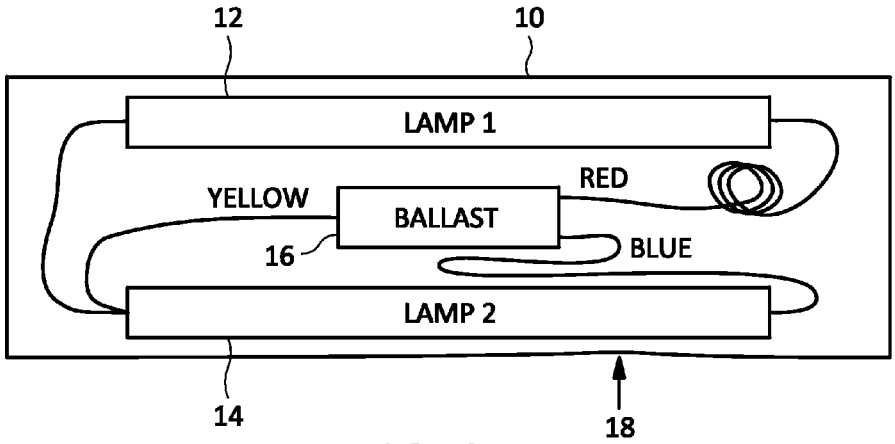
FIG. 1 (PRIOR ART)
FIG. 1 illustrates a prior art fluorescent light fixture.

Alternatively, a compensation system according to the inventive principles may be fabricated as an add-on kit for an existing ballast or light fixture. Referring to FIG. 1, a compensation system according to the inventive principles of this patent disclosure may be fitted inside the lamp housing 10, and the sense and control connections may be spliced or otherwise coupled to the red, blue and/or yellow leads as needed.

Another potential advantage to having a fully isolated version of a compensation system such as the embodiment of FIG. 4 is that it may facilitate integration with multiple lamps that are operated from separate power sources. For example, a three-lamp or four-lamp electronic ballast may include two separate inverter circuits, each of which operates one or two lamps. A compensation system according to the inventive principles of this patent disclosure may be used to compensate the intensity of all three or four lamps by using a suitable number of sensors and compensators. There may be no need for a common connection between any of the lamps, or between lamps that are grouped with the separate inverters.

The inventive principles may also be applied to compensating multiple lamps in one fixture that are driven by separate ballasts, multiple lamps in different fixtures that are driven by different ballasts, multiple lamps in different fixtures that are driven by one or more common ballasts, etc.

As discussed above, the embodiment of FIG. 5 includes a single compensator coupled to the first lamp 42, which may be described as the "upper" lamp if used in combination with the inverter of FIG. 6. A system having a single compensator may be suitable for use with such a combination because the upper lamp may be the one that is typically brighter than the other lamp when dimmed to low power levels. In other embodiments, however, one or more compensators may be included for each of both lamps, or if three or more lamps are connected in series, any number of compensators may be included for any of the series connected lamps.

In an embodiment with two series connected lamps, each having a separate compensator, the method of FIG. 5 may be modified to determine not only the magnitude of the difference between $I_1$ and $I_2$, but also the sign, i.e., which lamp is brighter. The appropriate compensator may then be adjusted accordingly.

The inventive principles of this patent disclosure have been described above with reference to some specific example embodiments, but these embodiments can be modified in arrangement and detail without departing from the inventive concepts. Thus, any changes and modifications are considered to fall within the scope of the following claims.

The invention claimed is:

1. A system for controlling fluorescent lamps comprising:

first and second fluorescent lamps coupled in series;

a first sensor to determine the intensity of the first fluorescent lamp;

a second sensor to determine the intensity of the second fluorescent lamp;

a compensator coupled in parallel with the first lamp and not the second lamp to control the intensity of the first lamp; and a controller coupled to the first and second sensors and the compensator to adjust the intensity of the first lamp to about the same intensity as the second lamp by controlling the compensator to divert current around the first lamp and to the second lamp, thereby changing the relative intensities of the first lamp and second lamp.

2. The system of claim 1:

further comprising a second compensator coupled in parallel with the second lamp and coupled to the controller; and wherein the controller adjusts the intensity of the second lamp by controlling the second compensator to divert current around the second lamp.

3. The system of claim 1 further comprising:

a third lamp; and a third sensor coupled to the controller to determine the intensity of the third lamp.

4. The system of claim 1 wherein the first sensor comprises a current transformer.

5. The system of claim 1 wherein the first sensor comprises a sense resistor.

6. The system of claim 1 wherein the first sensor comprises a voltage divider.

7. The system of claim 1 wherein the compensator comprises a passive network.

8. The system of claim 7 wherein the passive network comprises a capacitor and a variable resistor.

9. The system of claim 1 wherein the controller comprises a microcontroller.

10. The system of claim 1 wherein the controller comprises an analog comparator.

11. The system of claim 1 wherein the first sensor, the second sensor and the controller are electrically isolated from the first and second lamps.

12. A method for controlling fluorescent lamps comprising:

sensing the intensity of a first fluorescent lamp;

sensing the intensity of a second fluorescent lamp coupled in series with the first lamp;

coupling a compensator in series with the first lamp and not the second lamp to control the intensity of the first lamp; and compensating the first lamp to adjust the intensity of the first lamp to about the same intensity as the second lamp by controlling the compensator to divert current around the first lamp and to the second lamp, thereby changing the relative intensities of the first lamp and the second lamp.

13. The method of claim 12 further comprising:

sensing the intensity of a third lamp; and compensating any of the first, second or third lamps so the intensities of the first, second and third lamps are about equal.

14. The method of claim 12 wherein the intensity of the first lamp is adjusted continuously.

15. The method of claim 12 wherein the intensity of the first lamp is adjusted at relatively low dimming levels.

16. The method of claim 12 wherein the first and second lamps are operated by the same power source.

17. The method of claim 12 wherein the first and second lamps are operated by one ballast.

18. The method of claim 12 wherein the first and second lamps are located in the same light fixture.

19. The method of claim 12 wherein sensing the intensity of the first lamp comprises repeatedly measuring a first current through the first lamp until the measured current is within a first range for a first number of times.

20. The method of claim 19 wherein sensing the intensity of the second lamp comprises repeatedly measuring a second current through the second lamp until the measured current is within a second range for a second number of times.

21. The method of claim 12 wherein compensating the first lamp comprises:

comparing the intensity of the first lamp to the intensity of the second lamp; and adjusting the intensity of the first lamp if the intensities of the first and second lamps are outside of a range.

22. The method of claim 21 wherein adjusting the intensity of the first lamp comprises diverting more current around the first lamp to the second lamp.

23. The method of claim 22 wherein:

the intensity of the first lamp and the intensity of the second lamp are compared iteratively;

the intensity of the first lamp is adjusted iteratively; and more current is diverted in an incremental amount during each iteration.

24. The method of claim 22 wherein more current is diverted only if the difference between the intensity of the first lamp and the intensity of the second lamp exceeds a threshold for a minimum number of times.

25. A ballast comprising:

one or more power sources to operate a first lamp and a second lamp, wherein the first and second lamps are coupled in series;

a first sensor to determine the intensity of the first lamp;

a second sensor to determine the intensity of the second lamp;

a compensator coupled in series with the first lamp and not the second lamp to control the intensity of the first lamp; and a controller coupled to the first and second sensors and the compensator to adjust the intensity of the first lamp to about the same intensity as the second lamp by diverting current around the first lamp and to the second lamp, thereby changing the relative intensities of the first lamp and the second lamp.

26. The ballast of claim 25 further comprising:

a first set of one or more conductors to couple the ballast to a first end of the first lamp;

a second set of one or more conductors to couple the ballast to a second end of the first lamp; and a third set of one or more conductors to couple the ballast to a first end of the second lamp.

27. The ballast of claim 26 wherein:

the first sensor is coupled to the first set of conductors;

the second sensor is coupled to the third set of conductors; and the compensator is coupled between the first and second sets of conductors.

28. The ballast of claim 27 wherein the first set of conductors comprises a single conductor.

29. The ballast of claim 27 wherein the first set of conductors comprises two conductors to provide power to a filament.

30. The ballast of claim 27 wherein the second set of conductors comprises a center connection to couple the ballast to a second end of the second lamp.

31. The ballast of claim 30 wherein the first and second sensors each comprise a current transformer coupled to respective ones of the sets of conductors.

32. The ballast of claim 31 wherein the compensator comprises a network having a capacitor and variable resistor.

33. The ballast of claim 32 wherein the first, second and third sets of conductors each comprise two conductors to provide power to filaments.

34. A method for retrofitting an existing light fixture, the method comprising:

installing a first sensor in the existing fixture to determine the intensity of a first lamp in the fixture;

installing a second sensor to determine the intensity of a second lamp coupled in series with the first lamp in the existing fixture;

coupling a compensator to first and second conductors for the first lamp, wherein the compensator is coupled in parallel with the first lamp and not the second lamp;

installing a controller to control the compensator to adjust the intensity of the first lamp to about the same intensity as the second lamp by diverting current around the first lamp and to the second lamp, wherein the relative intensities of the first lamp and the second lamp are changed, thereby retrofitting the existing light fixture.

35. The method of claim 34 wherein:

the light fixture includes a ballast connected to the first and second lamps.

* * * * *